United States Patent [19]

Card

[11] 4,366,761

[45] Jan. 4, 1983

[54] DUAL SHIFTABLE NEEDLE BARS FOR TUFTING MACHINE

[75] Inventor: Roy T. Card, Chattanooga, Tenn.

[73] Assignee: Tuftco Corporation, Chattanooga, Tenn.

[21] Appl. No.: 212,147

[22] Filed: Dec. 2, 1980

[51] Int. Cl.[3] ..... D05C 15/14

[52] U.S. Cl. ..... 112/79 A; 112/79 R

[58] Field of Search ..... 112/79 A, 117, 79 R

[56] References Cited

U.S. PATENT DOCUMENTS

| | | | |
|---|---|---|---|
| 3,934,524 | 1/1976 | Smith | 112/79 A |
| 3,964,407 | 6/1976 | Ingram | 112/79 R |
| 3,964,408 | 6/1976 | Smith | 112/79 A |
| 4,173,192 | 11/1979 | Schmidt et al. | 112/79 R |

*Primary Examiner*—Ronald Feldbaum

*Attorney, Agent, or Firm*—Harrington A. Lackey

[57] ABSTRACT

A tufting machine having a pair of transversely shiftable needle bars and pattern-controlled discrete actuator means for independently shifting each of said needle bars in accordance with predetermined patterns.

11 Claims, 8 Drawing Figures

DUAL SHIFTABLE NEEDLE BARS FOR TUFTING MACHINE

BACKGROUND OF THE INVENTION

This invention relates to a needle bar positioning apparatus for a multiple needle tufting machine, and more particularly to a tufting machine having dual shiftable needle bars.

Heretofore, in the production of tufted fabrics, distinctive patterns, such as various zig-zag patterns, have been formed in backing fabrics by transversely or laterally shifting the needle bar, or by shifting the backing material support beneath the needle bar, needle-gauge increments for each stitch, in accordance with a predetermined pattern.

However, tufting machines for forming patterned tufting pile fabrics utilizing shiftable needle bars have only utilized a single needle bar. Examples of such a single-needle bar shifting means actuated by pattern cams are shown in U.S. Pat. Nos. 3,026,830 of Bryant et al, Mar. 27, 1962, and 3,109,395 of Batty et al, Nov. 5, 1963.

The U.S. Pat. No. 4,173,192 of Schmidt et al issued Nov. 6, 1979, discloses an electrohydraulic needle bar positioning apparatus for transversely shifting a single needle bar by hydraulic drive means controlled by electronic pattern means.

SUMMARY OF THE INVENTION

It is therefore an object of this invention to provide a multiple needle tufting machine incorporating a pair of transversely shiftable needle bars and separate actuator means for shifting the needle bars independently of each other in accordance with their own predetermined patterns.

This tufting machine, incorporating the independently shiftable dual needle bars, makes it possible to produce patterns in tufted fabric, which have heretofore only been produced in woven fabrics by Wilton looms, or by printing such patterns on finished tufted fabrics. Applicant is not aware of any prior art tufting machine which is capable of making many of the "Wilton" patterns which this tufting machine is capable of producing.

The tufting machine made in accordance with this invention incorporates a pair of front and rear parallel needle bars mounted for independent transverse movement of each other above a base fabric. Each needle bar supports a plurality of needles, spaced longitudinally of the respective needle bars, and preferably arranged in a staggered pattern, that is the front needle bars are staggered relative to the rear needle bars to provide a more narrow needle gauge.

The looper mechanism, including the hooks for cooperating with the needles in order to form loop pile or cut pile, is of known construction.

The yarn supply for the needles incorporates front yarn supply and guide means for feeding first yarns to the needles in the front needle bar arranged on the front of the tufting machine, and a rear yarn supply and guide means arranged on the rear of the machine for feeding second yarns to the needles in the rear needle bar.

Because of the separate supply of yarn in both the front and rear of the machine, most of the shift actuator elements for the needle bars are mounted at each end of the machine and substantially vertically above the needle bars. Such mounting not only conserves space and prevents interference of the needle bar shifting elements with the yarn supply and guide means, but also provides a more direct drive connection between the shift drive actuators and the respective needle bars. The pattern-controlled shift device for the front needle bar is located at one end of the machine, while the separate and independent shift drive actuator for the rear needle bar is located at the opposite end of the machine. Each shift drive actuator is provided with its own pattern-controlled attachment for independent control and shifting or non-shifting of the respective needle bar for each stitch cycle.

In a preferred form of the invention, the shift drive actuator and pattern-control device for each needle bar may be of the type disclosed in the prior U.S. Pat. No. 4,173,192 owned by the common assignee of this application, Tuftco Corporation of Chattanooga, Tenn.

By virtue of the dual transversely shiftable needle bars and their independently operated shift actuators, the two needle bars may move simultaneously in the same direction, or simultaneously in the opposite direction, or one needle bar may shift in either direction while the other needle bar remains stationary, or both needle bars may remain transversely stationary to function as a conventional staggered needle tufting machine.

Each needle bar actuator is programmed to shift its corresponding needle bar, when moved transversely, one or more increments, each increment being equal to an even multiple of the needle gauge, so that regardless of the stitching position of the needle, it will cooperate with a corresponding looper after the needle penetrates the fabric to form a yarn loop, since the loop hooks do not move transversely.

The tufting machine made in accordance with this invention is capable of producing many types of graphic patterns, such as diamond-shaped patterns with multicolored yarns, which are now capable of being produced only by Wilton looms or by printing.

Although the preferred shift drive actuators for independently shifting the dual needle bars are the electrohydraulic needle bar positioning apparatuses, such as that disclosed in the prior U.S. Pat. No. 4,173,192, it is possible to shift these needle bars with conventional mechanical shift actuators incorporating pattern cams.

DESCRIPTION OF THE PREFERRED EMBODIMENTS

Figure 1:
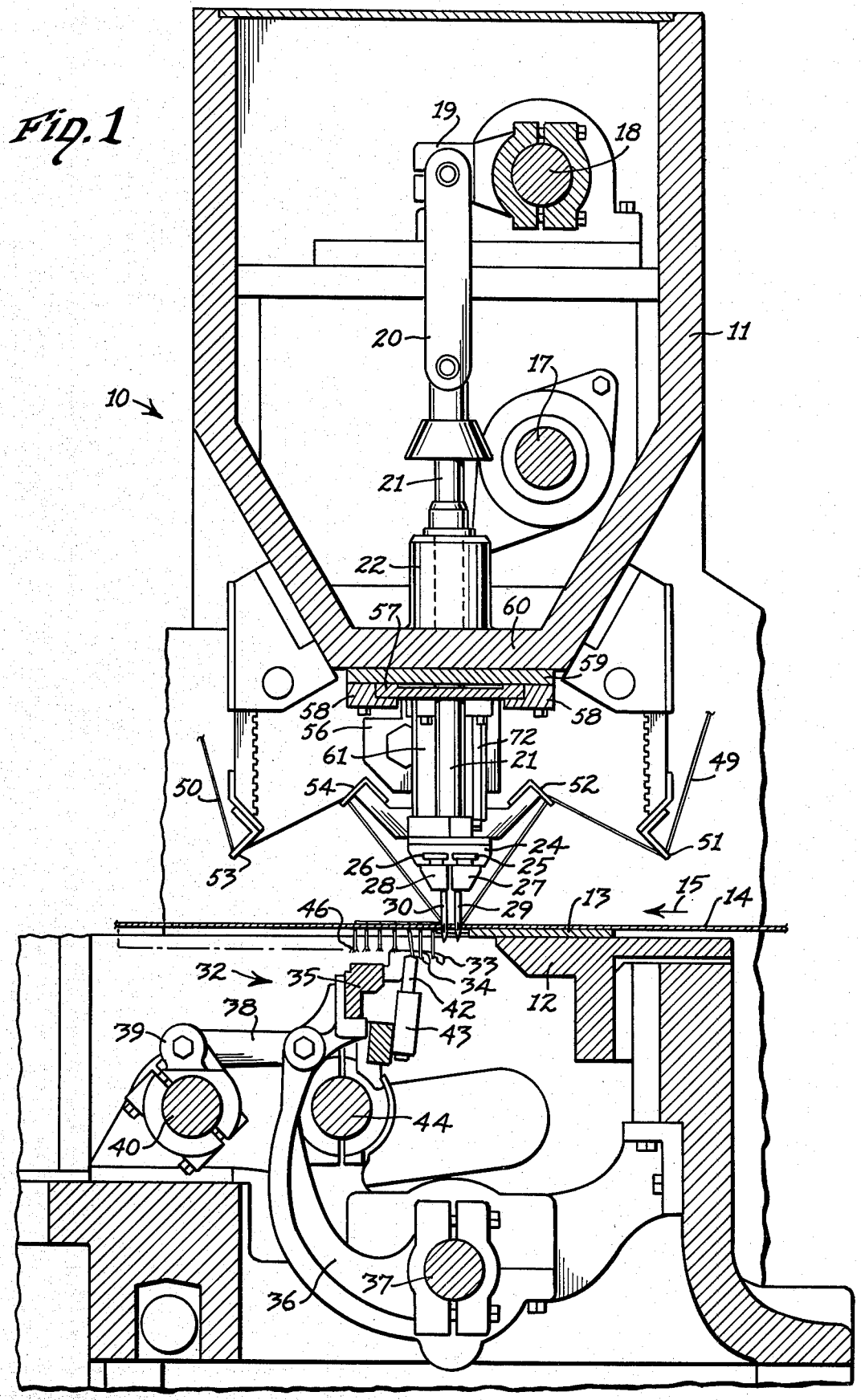
FIG. 1 is a fragmentary sectional elevation, taken along the line 1—1 of FIG. 3, of a tufting machine made in accordance with this invention.

Referring now to the drawings in more detail, FIG. 1 discloses a cross-section of a tufting machine 10 made in accordance with this invention. The machine 10 includes a housing 11 and a bed frame 12 upon which is fixed a needle plate 13 for supporting a base fabric 14 adapted to be moved through the machine 10 from front to rear in the direction of the arrow 15 by conventional fabric rollers, not shown.

A motor, not shown, drives a rotary main drive shaft 17, which is connected by linkage, not shown, for reciprocably rotating a needle rocker shaft 18 carrying rocker arms 19 pivotally connected through link arms 20 to push rods 21 reciprocably supported in corresponding push rod housings 22.

The mechanism described thus far is conventional in the art of tufting machines.

The lower end of each push rod 21 is fixedly connected to an elongated needle bar slide holder or foot 24 having a pair of parallel slide ways for reciprocably and slidably receiving slides 25 and 26 of substantially T-shaped cross-section. Each slide 25 and 26 is fixed to a respective front needle bar 27 and rear needle bar 28. The front needle bar 27 supports a plurality of uniformly spaced first or front needles 29 preferably aligned along the longitudinal axis of the needle bar 27. Rear needle bar 28 supports a plurality of uniformly spaced first or front needles 29 preferably aligned along the longitudinal axis of the needle bar 27. Rear needle bar 28 supports a plurality of preferably uniformly spaced second or rear needles 30 also preferably aligned along the longitudinal axis of the rear needle bar 28.

Figure 2:
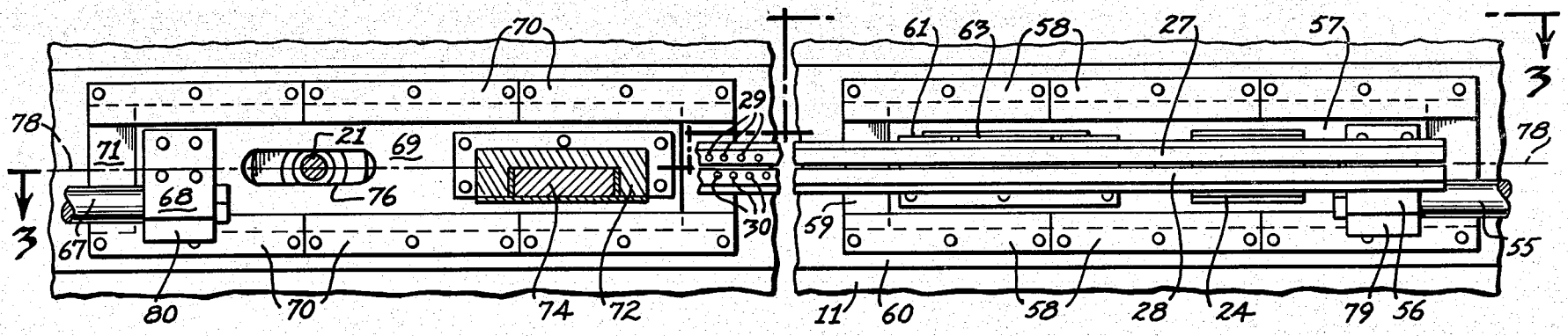
FIG. 2 is a fragmentary bottom sectional view taken along the line 2—2 of FIG. 3, with portions broken away.

The front needles 29 are preferably uniformly staggered midway between the rear needles 30, as disclosed in FIG. 2 to provide a more narrow gauge.

The looper mechanism 32, disclosed in FIG. 1, is of a known construction, preferably such as that disclosed in U.S. Pat. No. 4,003,321, issued Jan. 18, 1977, to the applicant, for "CUT PILE APPARATUS FOR STAGGERED NEEDLE TUFTING MACHINE." The looper mechanism 32 includes a plurality of alternate first and second cut pile hooks 33 and 34, each first cut pile hook 33 having a longer bill than each of the second cut pile hooks 34. However, the throats of the cut pile hooks 33 and 34 are all longitudinally aligned transversely of the feeding direction 15, as taught in the above Card U.S. Pat. No. 4,003,321, Each first cut pile hook 33 is adapted to cooperate with a first or front needle 29, while each cut pile hook 34 having a shorter bill is adapted to cooperate with a second or rear needle 30.

All of the cut pile hooks 33 and 34 are mounted and uniformly spaced at the same needle gauge as the needles 29 and 30 within a hook bar 35. The elongated cut pile hook bar 35, extending the width of the machine 10, is mounted on rocker arms 36, the lower ends of which are connected for rotary movement upon the looper shaft 37. The rocker arms 36 are pivotally connected through link arms 38 to rocker arms 39 fixed to a reciprocable jack shaft 40, in turn connected through appropriate linkage to the main shaft 17, in a conventional manner, for reciprocable movement.

Each of the cut pile hooks 33 and 34 cooperates with a knife 42 fixed in a knife holder 43, in turn supported upon the reciprocable knife shaft 44, also connected by linkage, not shown, to operate in timed relationship with the looper jack shaft 40, so that the knives 42 cooperate with the throats of the respective hooks 33 and 34 for severing yarn loops caught upon the bills of the hooks 33 and 34 to produce the cut pile tufts 46. All of the knives 42 are longitudinally aligned transversely of the machine 10, as described in the above Card U.S. Pat. No. 4,003,321.

It is also within the scope of this invention to replace the cut pile looper mechanism 32 with a loop pile looper mechanism in order to produce loop pile instead of cut pile, if desired.

Since there are two needle bars 27 and 28 supporting a front row of needles 29 and a rear row of needles 30, respectively, on a relatively narrow needle gauge, the needles extending the full width of the machine, two separate yarn supplies must be provided, one located on the front of the machine housing 11 and the other on the rear side of the machine 11 in order to supply the first or front yarns 49 to the front needles 29 and the second or rear yarns 50 to the rear needles 30. The yarns 49 and 50 may be fed by any conventional means, such as yarn feed rolls, not shown, mounted on the front and rear of the machine housing 11, respectively, from yarn supplies, such as yarn creels, also not shown. The yarns 49 are fed through corresponding yarn holes in a yarn guide 51 and a front yarn jerker 52 to the corresponding front needles 29, in a conventional manner. In like manner, the rear yarns 50 are fed through thread holes in the rear yarn guide 53 and the rear yarn jerker 54 to the corresponding rear needles 30.

Each of the needle bars 27 and 28 is independently controlled and actuated to shift longitudinally of its own axis transversely of the machine 10.

Figure 3:
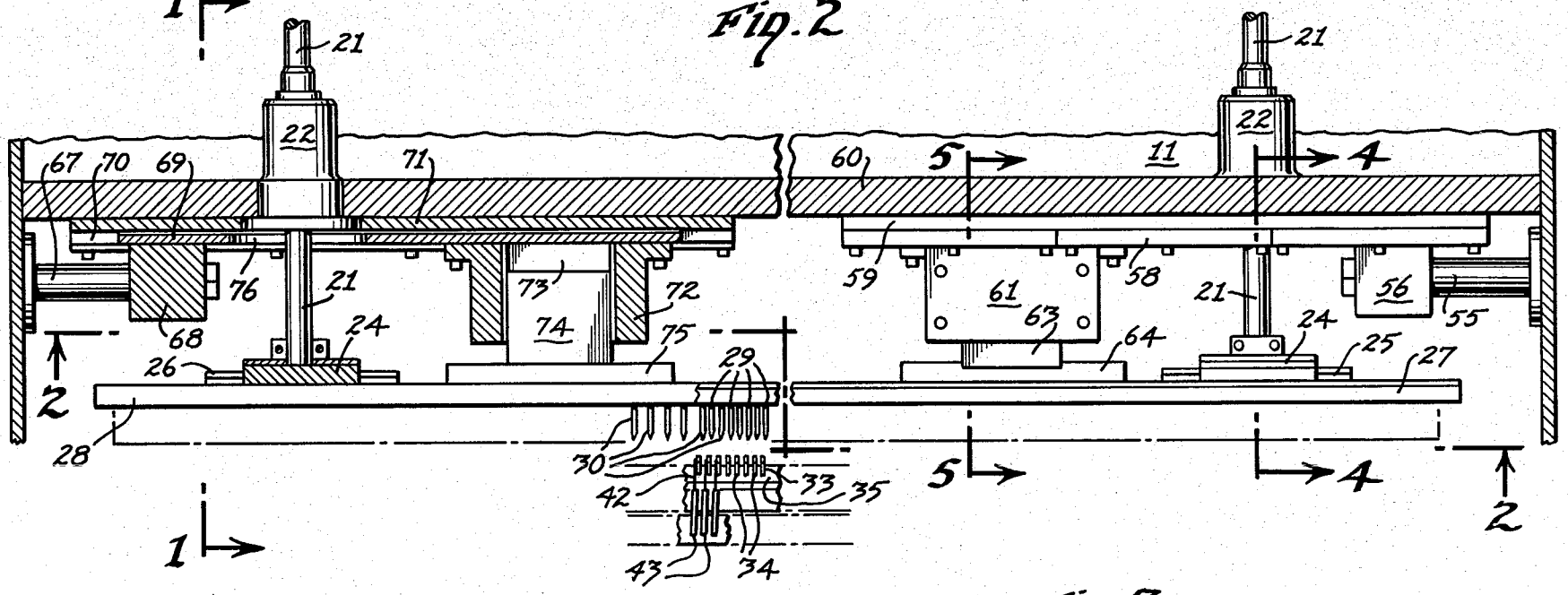
FIG. 3 is a fragmentary section taken along the line 3—3 of FIG. 2.
Figure 4:
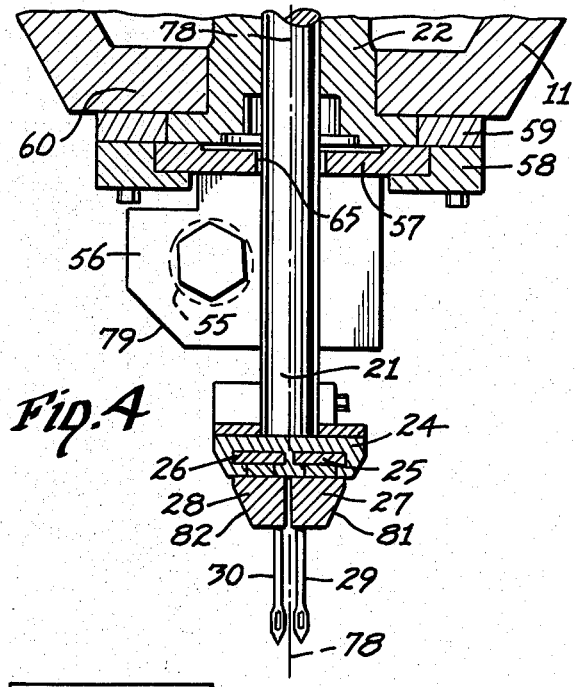
FIG. 4 is an enlarged fragmentary section taken along the line 4—4 of FIG. 3.

The front needle bar 27 is adapted to be shifted laterally by a transversely reciprocable shift rod 55 (FIGS. 2 and 3). The shift rod 55 is fixed to a shift block 56, which in turn is fixedly secured to a slide bar or plate 57 (FIGS. 2 and 4) slidably movable within the slide bracket sections or gibs 58 secured to a wear plate 59 fixed to the bottom wall 60 of the housing 11.

Figure 5:
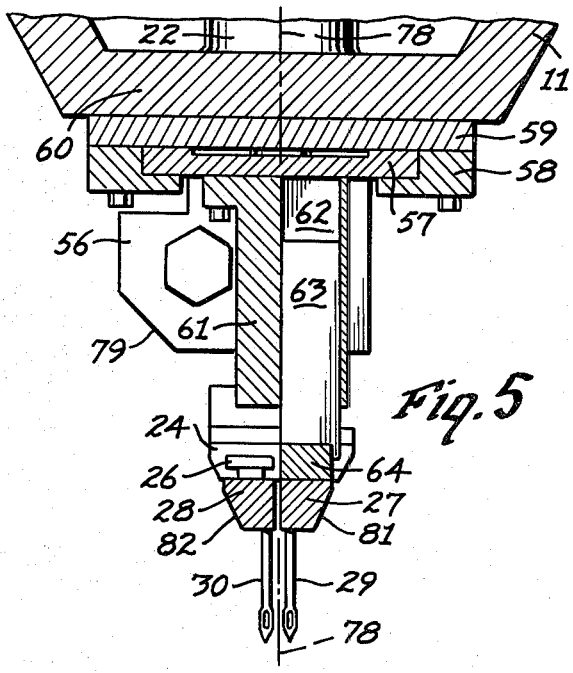
FIG. 5 is an enlarged fragmentary section taken along the line 5—5 of FIG. 3.

Fixed to and depending from the slide bar 57 and offset slightly forward of the longitudinal center line 78 of the slide bar 47 is a guide bracket or sleeve 61 including a vertical slot 62 for reciprocably receiving a guide member or tongue 63 projecting upward from and fixed to a connector bar 64, in turn fixed to the front needle bar 27 (FIGS. 3 and 5). The guide bracket 61 and guide member 63 are in substantial vertical alignment with the longitudinal axis of the front needle bar 27.

The slide bar or plate 57 is provided with an elongated slot 65 for receiving the vertically reciprocable push rod 21.

As disclosed in FIGS. 2 and 3, the shift rod 55 is located at the right end of the machine, and all of the elements, including the slide bar 47, guide sleeve 61 and guide member 63, are also located at the right end portion of the front needle bar 27 to permit the transverse shifting of the needle bar 27 while it is being reciprocated by the push rod 21.

In like manner, a second shift rod 67 is located at the left end of the machine to cause the shifting of the rear needle bar 28, through mechanisms and elements substantially identical to those connecting the shift rod 55 to the front needle bar 27.

The left shift rod 67 is fixed to a shift block 68, which in turn is fixed to a left slide bar or plate 69 slidably received for free transverse reciprocable movement in the guide bracket sections or gibs 70, which in turn are secured to the wear plate 71 fixed to the bottom wall 60 of the housing 11 at the left end portion of the machine 10, as best disclosed in FIGS. 2 and 3.

Fixed to and depending from the slide plate 69 is a guide bracket or sleeve 72 identical to, but the mirror-image of, the guide bracket 61, and depending along an axis slightly offset to the rear of the longitudinal axis 78 of the slide bar 69, to substantially vertically coincide with the longitudinal axis of the rear needle bar 28. The guide bracket 72 includes a vertical slot or opening 73 for freely, vertically reciprocably receiving the guide member or tongue 74 fixed to the rear needle bar 28 through the connector bar 75.

The slide bar 69 is also provided with an elongated slot 76 (FIG. 2) for receiving the vertically reciprocable push rod 21. The slot 76 should be long enough that the slide bar 69 may travel the full limit of its shifting movement without engaging the vertically reciprocable push rod 21. The slot 65 (FIG. 4) is identical to the slot 76, but the longitudinal extent of the slot 65 is hidden by the needle bars 27 and 28 in the right hand portion of FIG. 2.

The shift rod 67, slide bar 69, guide sleeve 72 and guide member 74 function in the same manner as the comparable elements connected between the right shift rod 55 and the front needle bar 27.

As the left shift rod 67 is moved toward the right of FIGS. 2 and 3, the slide bar 69 is moved a comparable distance to the right carrying with it the guide sleeve 72 and the guide member 64 which also causes the rear needle bar 28 to move to the right the same distance as the shift rod 67. Because of the elongated slot 76 and the free vertical reciprocable movement between the sleeve 72 and the guide member 74, the vertical reciprocable movement of the needle bar 28, through the drive of the vertically reciprocable push rod 21, is in no way interfered with by the transverse shifting movement of the shift rod 67 and the needle bar 28.

The rear needle bar 28 shifts transversely relative to the push rod 21 by virtue of the slidable connection between the slide 26 fixed to the needle bar 28 and the needle bar foot or holder 24.

It will be further noted that, although the shift rods 67 and 55 are located slightly rearward of the longitudinal vertical center line or plane 78 of the coaxial longitudinal center lines of the slide bars 67 and 57, and which plane 78 also contains the vertical axes of the push rods 21, most of the elements are located close to this vertical plane 78.

Furthermore, the two guide members 63 and 74 are located substantially vertically above their respective needle bars 27 and 28.

There are two important reasons for the substantial vertical location of the shifting elements above the needle bars 27 and 28 and near the vertical central plane 78. One reason is to prevent interference of any of the shifting elements and mechanisms with the yarn feed and guide devices, which must feed the first yarns 49 downward in front of the machine and the rear yarns 50 downward along the rear of the machine. In this regard, it will be noted that the rear surfaces of the shift blocks 56 and 68 are chamfered, as well as the outer lower surfaces of the respective needle bars 27 and 28, to reduce the possibility of interference between these parts 79, 80, 81 and 82 and the yarns 49 and 50.

The second reason for the centralized location of the shifting elements is to reduce the torque between the shift rods 55 and 67 and the respective elements connecting the shift rods to their respective needle bars 27 and 28, such as the slide bars 57 and 69, guide sleeves 61 and 72, and guide blocks or tongues 63 and 74. Thus the applied forces of the respective shift rods 55 and 67 are directed more nearly along and adjacent to the longitudinal axis of the center plane 78, as opposed to the location of a shift rod, such as 55, offset substantially to the rear of the center plane 78, such as in the area between the yarn jerker 54 and the yarn guide 53 as shown in FIG. 1. A yarn shifter rod has been located in such an offset area for driving a single needle bar in connection with the needle bar positioners made in accordance with the above cited U.S. Pat. No. 4,173,192, where no yarn feed or guide mechanisms were employed on the rear side of the tufting machine. Moreover, it is within the scope of this invention to locate the shift rods 55 and 67 coaxially in the center plane 78, and in fact a tufting machine has been built in accordance with this invention in which the shift rods have been located coaxially in the center plane 78.

Figure 6:
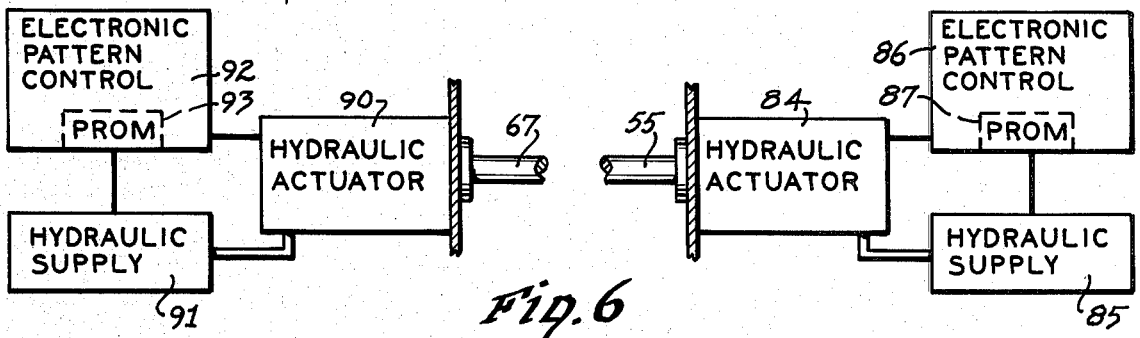
FIG. 6 is a schematic view, with a substantial portion of the middle of the machine removed, of the two independent shift drive actuators.

As disclosed in FIG. 6, the right shifter rod 55 is transversely shifted preferably by a hydraulic actuator 84 having a hydraulic supply 85 and an electronic pattern control 86 including a plug-in stitch pattern chip, such as the PROM 87, all of which mechanisms may be identical to those disclosed in the prior U.S. Pat. No. 4,173,192. The PROM 87 determines the program of the transverse shifting sequence of the shift rod 55.

In a similar manner, the shift rod 67 is driven by the hydraulic actuator 90 having the hydraulic supply 91 controlled by the electronic pattern control 92 including a replacable and interchangeable plug-in stitch pattern chip or PROM 93, also which may be made in accordance with the prior U.S. Pat. No. 4,173,192.

It is therefore evident from the pattern-controlled hydraulic actuators 84 and 90, disclosed in FIG. 6, that each of the shift rods 55 and 67, respectively, is independently programmed and shifted to provide the overall desired pattern of the finished tufted product.

It is also within the scope of this invention to have other types of actuators for the shift rods 55 and 67, which have pattern controls for programming the independent shifting of the shift rods in order to produce the desired stitch patterns. It is possible to provide separate rotary pattern cams of conventional designs for actuating the shift rods 55 and 78.

Figure 7:
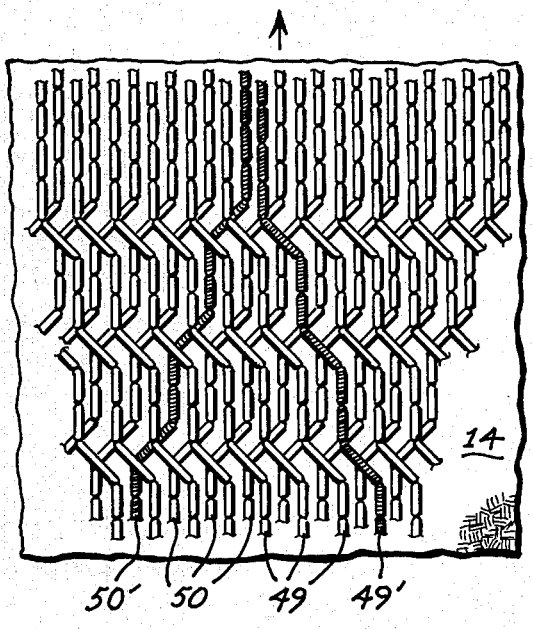
FIG. 7 is a fragmentary bottom plan view illustrating one style of patterned tufted pile fabric made in accordance with this invention.

FIG. 7 shows a fragment of the back of a base fabric 14 in which stitches are formed by the alternating front yarns 49 and rear yarns 50, and portions of the stitches are shown crossing, where the front needle bar 27 and rear needle bar 28 have shifted in opposite transverse directions. Darker colored front yarns 49' and rear yarns 50' are also indicated in FIG. 7.

Figure 8:
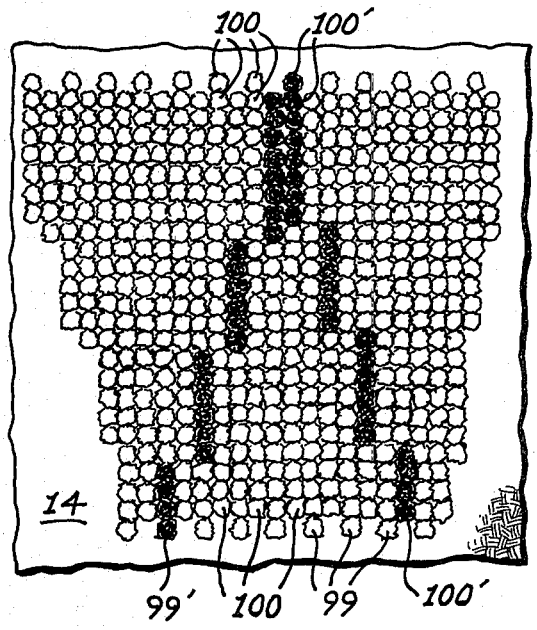
FIG. 8 is a fragmentary top plan view of the fabric disclosed in FIG. 7.

FIG. 8 shows the resulting pattern of first cut pile tufts 99 and second cut pile tufts 100, on the face of the base fabric 14 resulting from the stitching disclosed in FIG. 7. First rows of cut pile tufts of dark-colored yarns are indicated by the reference numerals 99', while the second rows of cut pile tufts of dark-colored yarns are indicated by the reference numerals 100'.

What is claimed is:

1. In a tufting machine having means for supporting a base fabric for longitudinal movement in a feeding direction through said machine, a patterned stitching mechanism comprising:

(a) a first elongated needle bar having a plurality of first needles spaced along said first needle bar, (b) a second elongated needle bar having a plurality of second needles spaced along said second needle bar, (c) means supporting said first and second needle bars parallel to each other on one side of the base fabric moving through the machine and transversely of said longitudinal feeding direction, for independent reciprocal movement longitudinally of said needle bars, and for reciprocable movement toward and away from the base fabric to cause said first and second needles to reciprocably penetrate the base fabric, (d) pattern-controlled actuator means operatively connected to said first and second needle bars to shift said needle bars independently of each other in predetermined increments transversely of said feeding direction, (e) yarn supply means supplying first yarn to said first needles and second yarn to said second needles, and (f) needle drive means for reciprocably moving said needle bars toward and away from the base fabric to cause said needles to stitch said yarns through the base fabric in accordance with the pattern determined by said pattern-controlled actuator means.

2. The invention according to claim 1 further comprising a looper mechanism on the other side of the base fabric moving through the machine, including reciprocably mounted first and second hooks, means for actuating said hooks in timed relation with said needle drive means so that said first hooks cooperate with said first needles and said second hooks cooperate with said second needles to form first and second yarn loops in the base fabric.

3. The invention according to claim 2 further comprising a knife cooperating with each of said hooks, and means for actuating said knives in timed relationship with said hooks to form cut pile tufts.

4. The invention according to claim 2 in which said needles have a normal predetermined needle gauge, the spacing of said first and second hooks being equal to said needle gauge, and said pattern-controlled actuator means being programmed to shift either of said needle bars a transverse increment equal to an even multiple of said needle gauge for a stitching cycle.

5. The invention according to claim 1 in which said pattern-controlled actuator means comprises a first shift rod operatively connected to said first needle bar, and first shift drive means operatively connected to said first shift rod for moving said first needle bar in predetermined increments transversely of said feeding direction, a second shift rod operatively connected to said second needle bar, and second shift drive operatively connected to said second shift rod for moving said second needle bar in predetermined increments parallel to said first needle bar and independently of the movement of said first needle bar.

6. The invention according to claim 5 in which said pattern-controlled actuator means further comprises a first slide bar mounted for reciprocal movement above and parallel to said first needle bar, said first slide bar being operatively connected to said first shift rod for reciprocal movement therewith, a first guide member fixed to and projecting upward from said first needle bar, and first sleeve means depending from said first slide bar and receiving said first guide member for free vertical reciprocal movement within said first sleeve means for simultaneous movement transversely of said feeding direction, a second slide bar mounted for reciprocable movement above and parallel to said second needle bar, said second guide bar being operatively connected to said second shift rod for reciprocal movement therewith, a second guide member fixed to and projecting upward from said second needle bar, and second sleeve means depending from said second slide bar and receiving said second guide member for free vertical reciprocal movement within said second sleeve means and for simultaneous movement transversely of said feeding direction.

7. The invention according to claim 6 in which said needle drive means comprises at least one push rod and means for vertically reciprocably moving said push rod, said lower end of said push rod terminating in a needle bar slide holder, first and second slides fixedly to the top portions of each of said first and second needle bars, respectively, both said slides being slidably received in said slide holder for free independent slidable movement and for simultaneous vertical movement with said push rod.

8. The invention according to claim 7 further comprising an elongated slot in each of said first and second slide bars for receiving a corresponding vertically reciprocable push rod therethrough, to permit free vertical movement of said push rod relative to said slide bar and free transverse movement of said slide bar relative to said push rod.

9. The invention according to claim 7 in which each of said first and second slide bars is substantially vertically above its corresponding first and second needle bar.

10. The invention according to claim 8 in which the machine has a front and a rear, said first needle bar being in front of said rear needle bar, said yarn supply means comprising first yarn guide means on the front of said machine for guiding said first yarns to said first needles, and second yarn guide means on the rear of said machine for guiding said second yarns to said second needles.

11. The invention according to claim 5 in which each of said first and second needle bars has a right end portion and a left end portion, said first shift rod being operatively connected to the right end portion of said first needle bar, and said second shift rod being operatively connected to the left end portion of said second needle bar.

* * * * *